US010400462B2

(12) United States Patent
South, Jr.

(10) Patent No.: US 10,400,462 B2
(45) Date of Patent: Sep. 3, 2019

(54) TRANSVERSE SPAN AIRFORM STRUCTURE

(71) Applicant: Monolithic Constructors, Inc., Italy, TX (US)

(72) Inventor: David B. South, Jr., Providence, UT (US)

(73) Assignee: Monolithic Constructors, Inc., Italy, TX (US)

( * ) Notice: Subject to any disclaimer, the term of this patent is extended or adjusted under 35 U.S.C. 154(b) by 0 days.

(21) Appl. No.: 15/146,840

(22) Filed: May 4, 2016

(65) Prior Publication Data

US 2017/0321438 A1 Nov. 9, 2017

(51) Int. Cl.

| | |
|---|---|
| ***E04G 11/04*** | (2006.01) |
| ***E04B 1/16*** | (2006.01) |
| ***E04B 1/32*** | (2006.01) |
| *E02D 27/02* | (2006.01) |

(52) U.S. Cl.

CPC ..... *E04G 11/045* (2013.01); *E04B 1/166* (2013.01); *E04B 1/169* (2013.01); *E04B 1/3211* (2013.01); *E02D 27/02* (2013.01); *E04B 2001/3264* (2013.01)

(58) Field of Classification Search

CPC ..... E04G 11/045; E04B 1/166; E04B 1/3211; E04B 2001/3217; B29C 65/002; B29L 2031/10

USPC ..... 52/2.24, 2.19, 2.11, 2.18, 2.16

See application file for complete search history.

(56) References Cited

U.S. PATENT DOCUMENTS 2,830,606 A * 4/1958 Daugherty ..... E04H 15/20 119/436
2,850,026 A * 9/1958 Leatherman ..... B64F 1/222 244/24
3,247,627 A * 4/1966 Bird ..... E04H 15/20 52/2.19

(Continued)

OTHER PUBLICATIONS

Monolithic Dome Institute, Monolithic Dome Bulk Storage, http://www.monolithic.org/storage/photos, to the best of the applicant's knowledge article was available before the application filed, 3 pages.

(Continued)

*Primary Examiner* — Joshua K Ihezie

(57) ABSTRACT

A transverse span for an airform membrane is disclosed that can include a material having a perimeter defined at least in part by a longitudinal edge having opposite ends that terminate at a base edge further defining the perimeter. The longitudinal edge can be configured to couple to a longitudinal edge of an adjacent transverse span of the airform membrane. The base edge can at least partially define a base perimeter of the airform membrane for coupling with a base support structure. The transverse span can also include a load compensated region with a length dimension and/or a width dimension reduced from an intended final dimension to compensate for stretch of the material when the airform membrane is inflated. In addition, the transverse span can include a flare region between the load compensated region and the base edge. The flare region can transition in the length dimension and/or the width dimension between the load compensated region and the base edge.

53 Claims, 10 Drawing Sheets

(56) References Cited

U.S. PATENT DOCUMENTS 3,816,885 A * 6/1974 Saether ..... E04H 15/22 24/462
4,271,641 A * 6/1981 Kawaguchi ..... E04B 1/342 52/2.18
4,384,435 A * 5/1983 Polise ..... E04H 15/20 52/2.19
5,097,548 A * 3/1992 Heck ..... A47G 9/0215 5/482
5,109,837 A * 5/1992 Gamow ..... A61G 10/026 128/200.24
5,857,294 A * 1/1999 Castro ..... E04B 7/105 52/6
5,893,238 A * 4/1999 Peacock ..... E04H 15/20 135/125
5,918,438 A * 7/1999 South ..... E04B 1/169 264/32
6,070,366 A * 6/2000 Pierson ..... E04H 15/22 52/2.17
6,282,842 B1 * 9/2001 Simens ..... E04H 15/20 52/1
6,282,843 B1 * 9/2001 Shibaike ..... E04H 15/20 52/2.11
6,840,013 B2 * 1/2005 South ..... E04B 1/169 52/2.15
7,791,799 B1 * 9/2010 Lejeune ..... G03B 21/00 359/443
8,366,051 B2 * 2/2013 Bigelow ..... B64F 1/02 244/158.3
8,763,309 B2 * 7/2014 Griffis ..... E04B 1/34357 52/2.11
9,015,998 B2 * 4/2015 Turcot ..... E04H 15/20 52/2.13
2002/0083653 A1 * 7/2002 Hilbert ..... E04H 1/1277 52/2.17
2005/0210767 A1 * 9/2005 DeFever ..... E04B 1/169 52/80.1
2007/0094937 A1 * 5/2007 Pedretti ..... E01D 15/122 52/2.11
2008/0313969 A1 * 12/2008 Colucci ..... E04H 15/20 52/2.18
2009/0217930 A1 * 9/2009 Holley ..... E04B 1/166 128/205.26
2009/0282746 A1 * 11/2009 Luchsinger ..... E04H 15/20 52/2.11
2014/0291448 A1 * 10/2014 Luck ..... B64B 1/14 244/123.14

OTHER PUBLICATIONS

Parker, Caledonia, Missouri Adds Two More Monolithic Domes, http://www.monolithic.org/school.caledonia-missouri-adds-two-more-monolithic-domes, Monolithic Schools: New Developments, May 21, 2010, 5 pages.
Parker, Lesson. Learned: Stick-to-itiveness Pays Off, http://monolithic.org/featured/featured-schools/lesson-learned-stick-to-itiveness-pays-off, Featured Monolithic Dome Schools, Feb. 24, 2009, 15 pages.
Shelter-Rite, Massive Clear Span Air Structure Makes Baseball Possible Year Round, http://www.architecturalfabrics.com/project-profiles/clear-span-air-structure-stadium, Seaman Corporation, Mar. 1, 2016, 3 pages.
VERSEIDAG INDUTEX DMBH, duraskin biogas fabrics, http://www.productpilot.com/en/suppliers/verseidag-indutex-gmbh/product/mf_bata_0041280502/en, to the best of the applicant's knowledge article was available before the application filing date, 2 pages, productpilot.com, Germany.

* cited by examiner

TRANSVERSE SPAN AIRFORM STRUCTURE

BACKGROUND

For decades, dome-type building structures have been constructed using an inflatable airform membrane in the desired dome shape as a framework for construction. Such dome building structures are made by securing an airform membrane to a foundation, inflating the airform membrane, and applying building materials to an interior of the airform membrane, using the airform membrane, at least initially, for support. For example, an insulating foam material is typically sprayed on an interior surface of the inflated airform membrane, followed by securing a reinforcing mesh to the cured foam layer, and applying one or more layers of a cementitious material to the foam layer so as to embed the reinforcing mesh and provide a self-supporting shell-like dome structure. A typical airform membrane, which forms the key component in constructing these dome structures, is made of generally triangular-shaped fabric sections, called gores, that extend radially from the top of the airform membrane and are seam-welded to one another to form an airtight membrane of a desired dome shape.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 1:
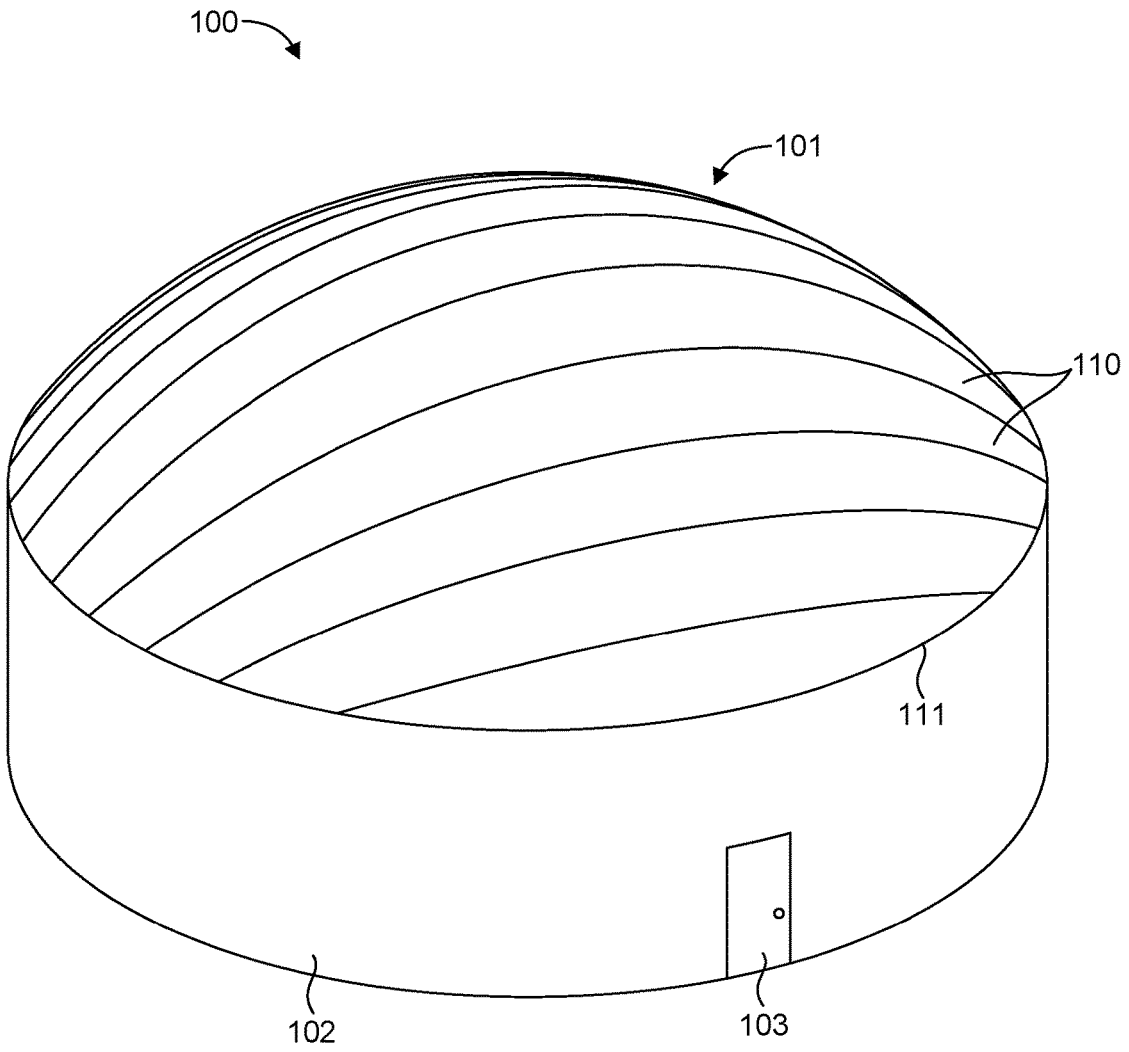
FIG. 1 is an illustration of a building structure in accordance with an example of the present disclosure.

Reference will now be made to the exemplary embodiments illustrated, and specific language will be used herein to describe the same. It will nevertheless be understood that no limitation of the scope of the invention is thereby intended.

DETAILED DESCRIPTION

An initial overview of technology embodiments is provided below and then specific technology embodiments are described in further detail later. This initial summary is intended to aid readers in understanding the technology more quickly but is not intended to identify key features or essential features of the technology nor is it intended to limit the scope of the claimed subject matter.

Although typical airform membranes made of radial gores have been successfully utilized in constructing dome building structures for many years, these airform membranes do have some drawbacks. In particular, there is an increasing demand for low-profile dome structures, which have effective diameters that subject the inflated airform membranes to higher levels of internal tensile forces thereby rendering the airform membranes more prone to failure. Radial gore airform membranes have attributes that increase the likelihood of failure in adverse weather conditions, which compounds the problems presented by large effective diameter airform membranes. Thus, typical radial gore airform membranes can limit the size and/or the low-profile nature of a dome building structure. In addition, the radial gore airform membranes have many seams that converge at a relatively small area, which hinders manufacture of the membranes, as well as gore patterns that inefficiently utilize material stock.

The present application seeks to disclose a transverse span for an airform membrane that can provide various benefits and advantages, such as improved safety, compared to radial gores, thus facilitating construction of large effective diameter dome structures. In one aspect, utilizing transverse spans in an airform membrane can reduce membrane internal tension in storm conditions, providing improved safety over typical radial gore airform membrane construction. In another aspect, transverse spans can reduce the number of seams compared to a radial gore airform membrane, thus reducing airform manufacture time, as well as maximizing usage of stock material thereby minimizing material waste. The transverse span can include a material (e.g., a fabric sheet) having a perimeter defined at least in part by at least one longitudinal edge having opposite ends that terminate at at least one base edge further defining the perimeter. The at least one longitudinal edge can be configured to couple to a longitudinal edge of an adjacent transverse span of an airform membrane. The at least one base edge can at least partially define a base perimeter of the airform membrane for coupling with a base support structure. The transverse span can also include a load compensated region with at least one of a length dimension and a width dimension reduced from an intended final dimension to compensate for stretch of the material when the airform membrane is inflated. Additionally, the transverse span can include at least one flare region between the load compensated region and the at least one base edge. The at least one flare region can transition in at least one of the length dimension and the width dimension between the load compensated region and the at least one base edge.

In one aspect, a transverse span airform membrane is disclosed that can comprise a plurality of transverse spans coupled to one another. At least one of the transverse spans can include a material having a perimeter defined at least in part by at least one longitudinal edge having opposite ends that terminate at at least one base edge further defining the perimeter. The at least one longitudinal edge can be configured to couple to a longitudinal edge of an adjacent transverse span of the airform membrane. The at least one base edge can at least partially define a base perimeter of the airform membrane for coupling with a base support structure. The at least one of the transverse spans can also include a load compensated region with at least one of a length dimension and a width dimension reduced from an intended final dimension to compensate for stretch of the material when the airform membrane is inflated. In addition, the at least one of the transverse spans can include at least one flare region between the load compensated region and the at least one base edge. The at least one flare region can transition in at least one of the length dimension and the width dimension between the load compensated region and the at least one base edge.

In another aspect, a transverse span airform membrane is disclosed that can comprise a plurality of transverse spans coupled to one another. At least one of the transverse spans can include a material having a perimeter defined at least in part by at least one longitudinal edge having opposite ends that terminate at at least one base edge further defining the perimeter. The at least one longitudinal edge can be configured to couple to a longitudinal edge of an adjacent transverse span of the airform membrane. The at least one base edge can at least partially defining a base perimeter of the airform membrane for coupling with a base support structure. The transverse span airform membrane can also include a load compensated region having a dimension reduced from an intended final dimension to compensate for stretch of the material when the airform membrane is inflated. In addition, the transverse span airform membrane can include a flare region transitioning in the dimension between the load compensated region and the base perimeter.

In one aspect, a building structure is disclosed that can comprise a base support structure, and a transverse span airform membrane coupled to the base support structure and in an inflated configuration. The transverse span airform membrane can include a plurality of transverse spans. At least one of the transverse spans can comprise a material having a perimeter defined at least in part by at least one longitudinal edge having opposite ends that terminate at at least one base edge further defining the perimeter. The at least one longitudinal edge can be configured to couple to a longitudinal edge of an adjacent transverse span of the airform membrane. The at least one base edge can at least partially define a base perimeter of the airform membrane for coupling with the base support structure. The at least one of the transverse spans can also comprise a load compensated region with at least one of a length dimension and a width dimension reduced from an intended final dimension to compensate for stretch of the material when the airform membrane is inflated. Additionally, the at least one of the transverse spans can comprise at least one flare region between the load compensated region and the at least one base edge. The at least one flare region can transition in at least one of the length dimension and the width dimension between the load compensated region and the at least one base edge.

FIG. 1 illustrates a building structure 100 in accordance with an example of the present disclosure. The building structure 100 can include an airform membrane 101, which is typically made of a tough fabric, such as PVC coated polyester or nylon fabric. The building structure 100 can also include a base support structure 102. The airform membrane 101 can be coupled to the base support structure 102, such as by securing a peripheral bottom edge 111 of the airform membrane 101 to the base support structure 102. The coupling of the airform membrane 101 and the base support structure 102 can be done in a manner so as to form an air-tight or substantially air-tight seal, such that the airform membrane 101 can be inflated into a dome as illustrated in the figure. Typically, the airform membrane 101 will be inflated with air provided by one or more blowers or fans. The inflated airform membrane 101 can serve as a framework or skeleton for the construction of a rigid dome structure, as described in more detail further below, typically made of reinforced concrete and foam insulation.

The base support structure 102 can include any suitable support structure for a building, such as a footing or a wall. A stem wall may be utilized to provide a vertical wall for a door 103 or a window in the building structure 100.

The airform membrane 101 can include a plurality of sections or portions of material (e.g., fabric) referred to generally as transverse spans 110, meaning that they extend in a transverse direction relative to the base support structure 102. These spans 110 can be coupled to one another (e.g., by welding) to form the airform membrane 101. Characteristics of the transverse spans 110 are discussed in more detail below.

Figure 2A:
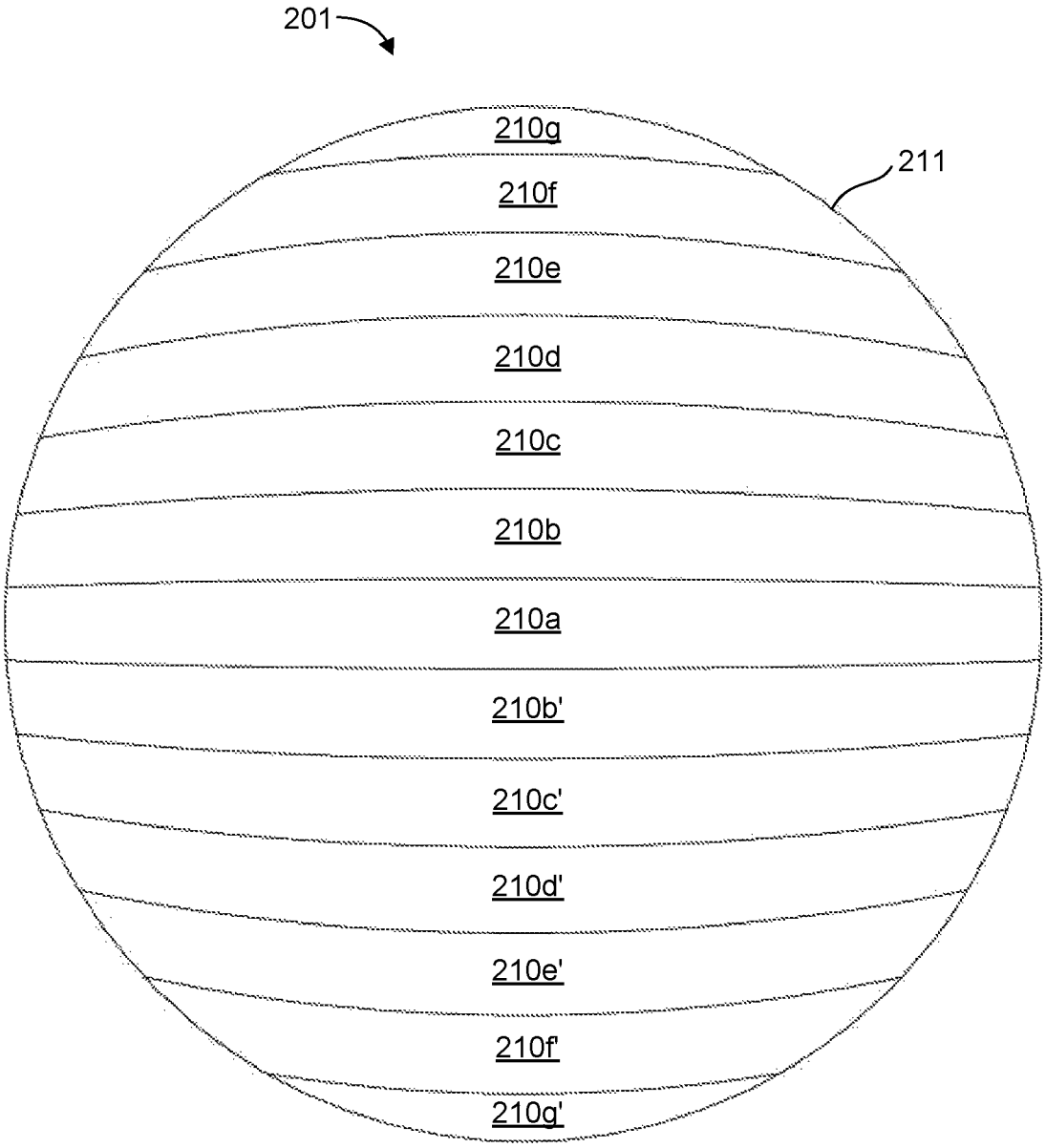
FIG. 2A is a top view of a transverse span airform membrane in accordance with an example of the present disclosure.
Figure 2B:
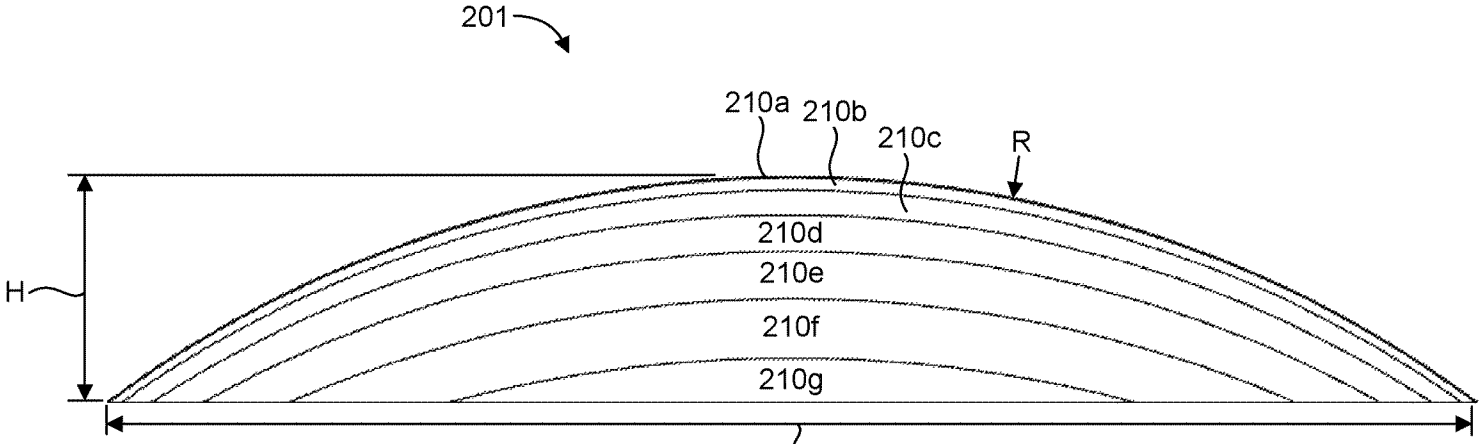
FIG. 2B is a side view of the transverse span airform membrane of FIG. 2A.
Figure 2C:
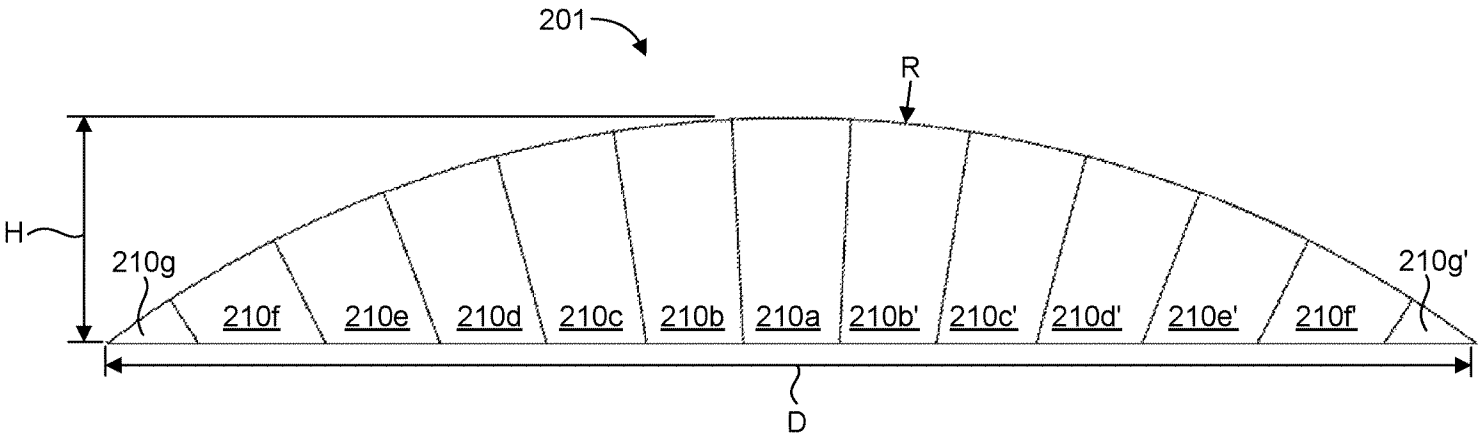
FIG. 2C is another side view of the transverse span airform membrane of FIG. 2A.

FIGS. 2A-2C illustrate an airform membrane 201 in accordance with an example of the present disclosure. The airform membrane 201 is illustrated in an inflated dome configuration. Domes provided by the airform membranes disclosed herein can be of any suitable configuration. Domes will commonly be configured as surfaces of revolution, although other configurations are possible. Typically, the surfaces of revolution utilized for domes will include semi spheroids, such as semi spheres and semi ellipsoids (e.g., a spheroidal cap), although domes can be configured as any suitable surface of revolution. Generally, an airform membrane configured as a semi spheroid will include less than half of a spheroid. For example, the airform membrane 201 is illustrated as a semi sphere that is less than half of a sphere. This configuration provides a circular base perimeter 211, as shown in FIG. 2A. In another example, an airform membrane can be configured as a semi ellipsoid that is less than half of an ellipsoid. In this case, the semi ellipsoid can be a semi prolate ellipsoid or a semi oblate ellipsoid. In one aspect, a surface of revolution can be oriented such that an axis of revolution is vertical. Thus, semi prolate ellipsoids and semi oblate ellipsoids with vertically oriented axes of revolution can have circular base perimeters. In another aspect, a surface of revolution can be oriented such that an axis of revolution is non-vertical (e.g., horizontal). Thus, semi prolate ellipsoids and semi oblate ellipsoids with non-vertically oriented axes of revolution can have elliptical base perimeters. In some cases, an airform membrane can be configured as a complex shape, such as a "multi-dome." In a multi-dome configuration, multiple domes can be combined in a single airform membrane. For example, a multi-dome can include two or more surfaces of revolution as described above, which can include convex portions, concave portions, saddles, smooth contours, contiguous shapes, etc. The airform membrane resulting from a combination of multiple domes can have a complex base perimeter shape (e.g., see FIGS. 11-12).

A height H and a base diameter D of the airform membrane 201 are illustrated in the side views of FIGS. 2B and 2C. As mentioned above, an airform membrane can be configured as less than half of a spheroid. Thus, the airform membrane 201 can have a height to base diameter ratio (H:D) of less than 1:2. In one aspect, a H:D range can be from about 1:2.1 to about 1:12. In a particular aspect, a low profile airform membrane can have a H:D less than about 1:3. A typical low profile airform membrane can have a H:D from about 1:4 to about 1:9.

As mentioned above, inflated airform membranes form a framework for construction of rigid dome structures. Airform membranes are typically inflated with blowers or fans to provide an internal air pressure of about 2 inches of water column. The internal air pressure is maintained while materials are added to form the rigid dome structures. The tension in a spherical airform membrane is equal to the internal pressure (P) multiplied by the radius (R) of the underlying sphere, divided by 2 (i.e., tensile force=PR/2). As H:D for airform membranes becomes increasingly low profile, the size (i.e., the radius R) of the underlying spheres increases. This means that increasingly low profile airform membranes have higher tension in the membranes and, therefore, may be more prone to failure. Airform membranes can initially fail at the top (e.g., seams pull apart) or the bottom of the membrane (e.g., failure of attachment, or inadequate attachment, with a base support structure). Membrane tension and airform membrane failure is discussed in more detail below.

In the example shown, the airform membrane 201 includes 13 spans 210*a-g*, 210*b*'-g', although any suitable number of spans can be utilized. These spans are configured as longitudinal or transverse material portions that span across the airform membrane 201.

Figure 3:
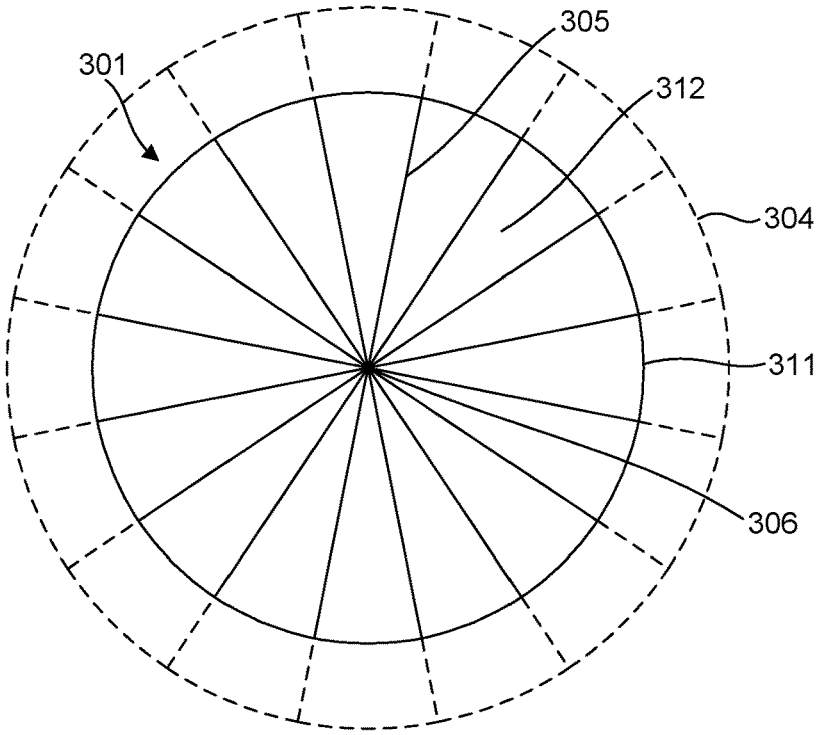
FIG. 3 is top view of a typical radial gore airform membrane.

FIG. 3 illustrates a top view of a conventional gore configuration for constructing an airform membrane 301. In this example, the airform membrane 301 is a spherical cap of a sphere 304, which is defined by a circular base perimeter 311 on the sphere 304. The airform membrane 301 is made of gores 312, which are sections of material that extend from a top center portion of the airform membrane 301. The gores 312 are defined by longitudinal lines 305 and resemble radial spokes in the top view of FIG. 3. Each gore 312 is identical. When the gores 312 are laid flat the shape becomes a generally triangular shape with slightly curved sides. There are typically an even number of gores in a radial gore airform membrane. Often, this means that gores do not use the full width of a supplied fabric, which results in waste. In addition, when welding two gores together along the curved sides, the degree of curvature can require many welding increments with a short, straight bar welder in order to approximate the curvature of the gores. Furthermore, the top of the airform membrane 301 where the narrow tips of the gores converge is typically labor intensive to assemble and weld, due at least in part to the congestion of seams in the area.

Figure 4:
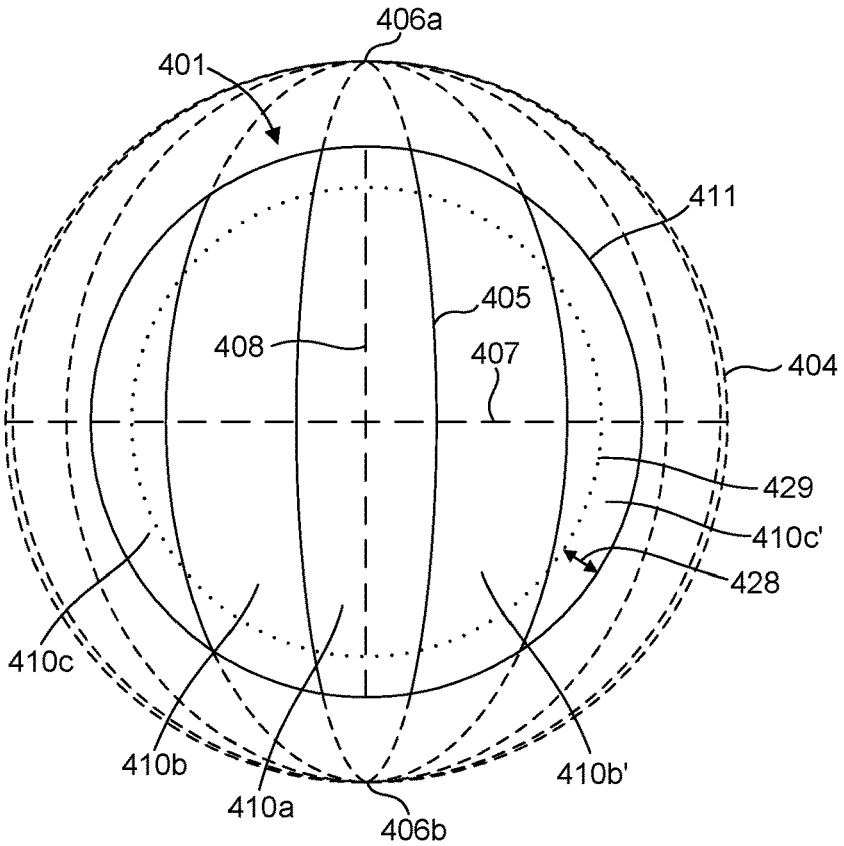
FIG. 4 is a top view of a transverse span airform membrane in accordance with another example of the present disclosure.

FIG. 4 illustrates a top view of a transverse or longitudinal span material configuration for constructing an airform membrane 401. Several aspects of transverse or longitudinal span airform membranes are discussed above with respect to FIG. 2, in particular. The concepts and principles discussed with respect to FIG. 4 elaborate and expand on those aspects discussed above. For comparison with the typical radial gore airform membrane 301 of FIG. 3, the airform membrane 401 is also a spherical cap of a sphere 404, which is defined by a circular base perimeter 411 on the sphere 404. The airform membrane 401 is made of transverse spans 410*a-c*, 410*b*'-c', which are sections of material that extend across the airform membrane 401 from opposite sides. As described in more detail below, the spans 410*a-c*, 410*b*'-c' are defined by longitudinal lines 405. Although the radial gores 312 of FIG. 3 may also be defined by the longitudinal lines 305, the airform membrane 301 is configured such that the radial gores converge at a "pole" 306 of the sphere 304, which is located at a top of the airform membrane 301. On the other hand, the airform membrane 401 is configured such that "poles" 406*a*, 406*b* of the sphere 404 are located laterally of the airform membrane 401, which locates an "equator" 407 of the sphere 404 at a top of the airform membrane 401. Thus, as shown in FIG. 4, the poles 406*a*, 406*b* where the longitude lines converge, are not included in the airform membrane 401, because the poles 406*a*, 406*b* are outside of the base perimeter 411. In other words, the airform membrane 401 effectively includes the side of the typical radial gore airform membrane 301, not the troublesome top or pole 306 where the gores 312 converge. In contrast to the radial gores 312, the spans 410*a-c*, 410*b*'-c' of the transverse airform membrane 401 are referred to as such because these sections run from one side of the base perimeter 411 to the other and span the airform membrane 401, unlike the typical radial gores 312, which only extend about half-way across the airform membrane 301. In addition, the transverse spans differ from radial gores in that the maximum width of a span is at the center or midpoint of the span along a length dimension (e.g., at the equator 407), whereas the maximum width of a radial gore is at an end of the gore (i.e., at the base perimeter 311).

The longitudinal sections defining the gores 312 of FIG. 3 and the spans 410*a-c*, 410*b*'-c' of FIG. 4 are similarly sized (e.g., the same angle between longitudinal lines). It can be observed that while 16 radial gores 312 are utilized to form the airform membrane 301 of FIG. 3, only 5 longitudinal spans 410*a-c*, 410*b*'-c' are needed to form the airform membrane 401 of FIG. 4, due to the spans utilizing the wider portions of the longitudinal sections. The curvature of the longitudinal edges of the spans 410*a-c*, 410*b*'-c' is much gentler or less pronounced than that of the radial gores 312, thus, enabling use of a longer straight weld bar to approximate the curvature when welding the spans together, which simplifies construction and saves time. In addition, because the spans 410*a-c*, 410*b*'-c' span across the airform membrane 401, the spans can be welded or seamed across the entire airform membrane 401 in one sequence as opposed to only welding or seaming half of the airform membrane 301 at a time, which represents a time savings over typical airform membrane construction. Furthermore, fewer seams to weld also provides a time advantage over typical airform membrane construction.

In the example illustrated in FIG. 4, the center span 410*a* straddles a centerline 408 of the airform membrane 401. In this single center span configuration, the airform membrane 401 includes an odd number of spans. Alternatively, two center spans can be joined along longitudinal edges that lie on the centerline 408 of the airform membrane 401. In other words, two center spans can be disposed on opposite sides of the centerline 408, with the centerline 408 being on the common border between the two center spans. In this dual center span configuration, the airform membrane can have an even number of spans.

As mentioned above, a typical point of failure for airform membranes is at the top of the membrane, such as seams pulling apart. Weather is often a factor in airform membrane failure. Typical radial gore airform membranes have been observed in normal conditions to have slightly depressed top portions where the radial gores converge. This presents a locally increased effective radius of the airform membrane, which creates a higher tension in the membrane. Storm conditions (e.g., winds) can exacerbate the problem by changing the internal pressure and/or the shape of the inflated airform membrane. In particular, the tops of radial gore airform membranes have been observed to lower in storm conditions, which can flatten the airform membrane and locally increase the effective radius even further. The result is an increase in the tension in the airform membrane that can be sufficient to cause a failure in a seam between gores and/or tear the airform fabric material. On the other hand, the tops of transverse span airform membranes have been observed to raise or elevate in storm conditions, thus locally reducing the effective radius. The result is therefore a reduction or relief in the tension of transverse span airform membranes in storm conditions. Radial gore airform membranes therefore have attributes that increase the likelihood of failure in storm conditions, while transverse span airform membranes have attributes that decrease the likelihood of failure in storm conditions. Thus, not only are transverse span airform membranes easier and less time consuming to construct than radial gore airform membranes, but transverse span airform membranes are safer as well.

Figure 5:
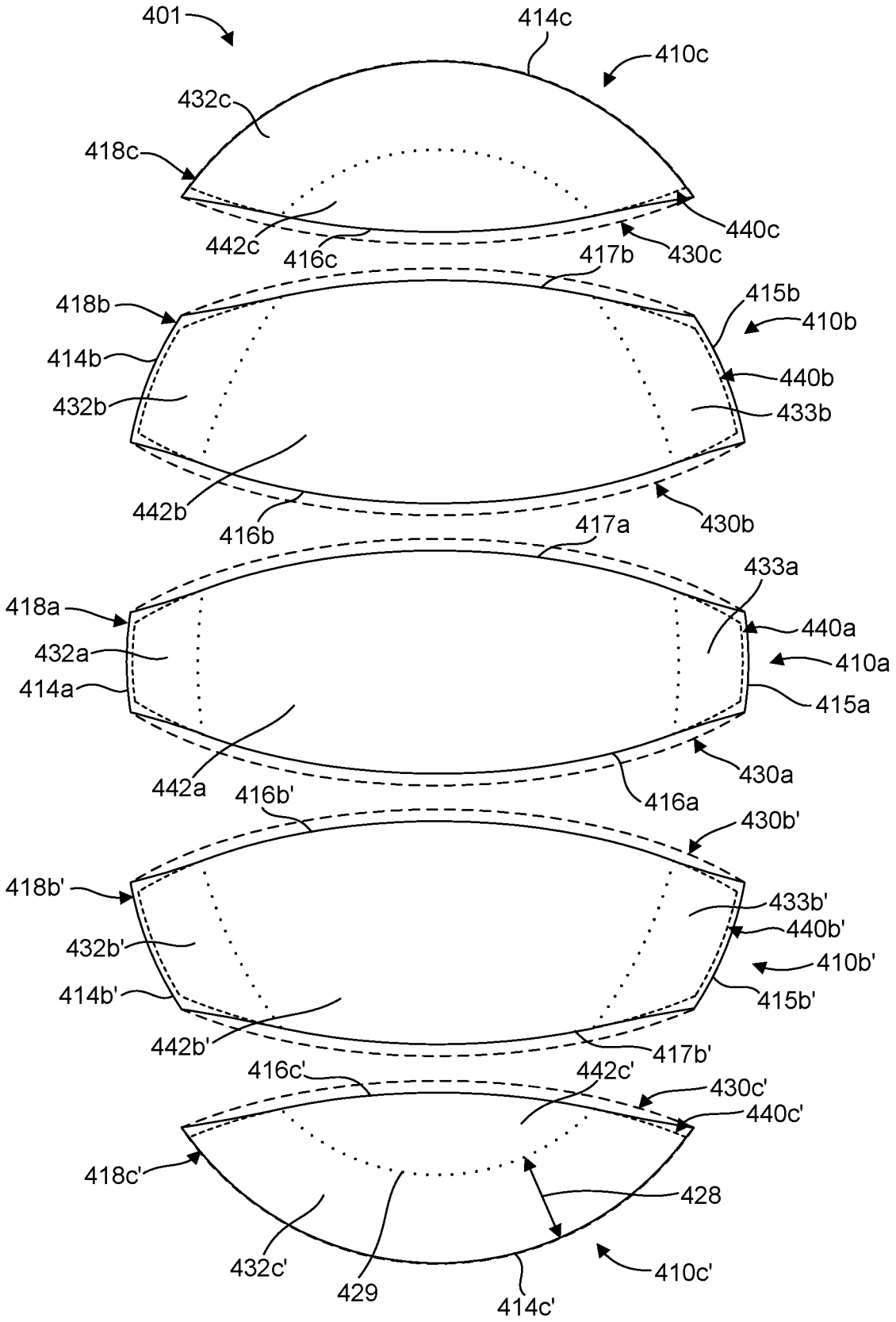
FIG. 5 is a plan view of transverse spans of the transverse airform membrane of FIG. 4, in accordance with an example of the present disclosure.
Figure 6:
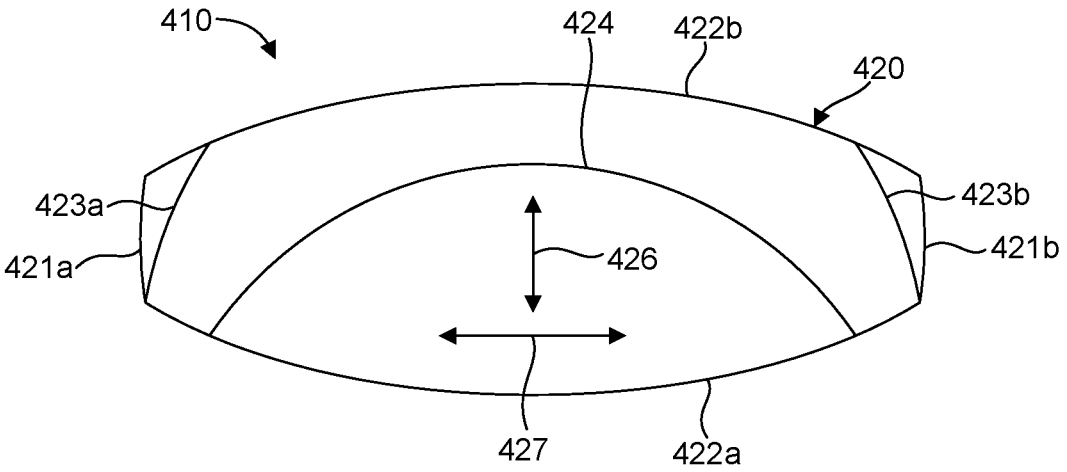
FIG. 6 is an illustration of a master transverse span used to create the transverse spans of FIG. 5, in accordance with an example of the present disclosure.

FIG. 5 illustrates a plan view of the spans 410*a-c*, 410*b*'-c' of the transverse airform membrane 401 of FIG. 4. The spans 410*a-c*, 410*b*'-c' are based on a master span 410 illustrated in FIG. 6. The master span 410 is based on the final desired shape and size of the airform membrane 401 and is discussed in more detail below. In general, each span 410*a-c*, 410*b*'-c' of the airform membrane 401 can include a fabric sheet having a perimeter defined by a base edge that at least partially defines the base perimeter 411 of the airform membrane 401, and a longitudinal edge having opposite ends that terminate at the base edge. The longitudinal edge can be configured to couple to a longitudinal edge of an adjacent span of the airform membrane, and the base perimeter 411 of the airform membrane 401 can be sized to couple with a base support structure.

Interior spans, such as the spans 410*a*, 410*b*, 410*b*', can include base edges on opposite ends. For example, the span 410*a* can include base edges 414*a*, 415*a*, the span 410*b* can include base edges 414*b*, 415*b*, and the span 410*b*' can include base edges 414*b*', 415*b*'. The interior spans 410*a*, 410*b*, 410*b*' can also include longitudinal edges with opposite ends that terminate at the base edges. For example, the span 410*a* can include longitudinal edges 416*a*, 417*a*, the span 410*b* can include longitudinal edges 416*b*, 417*b*, and the span 410*b*' can include longitudinal edges 416*b*', 417*b*'. For a given interior span (e.g., spans 410*b*, 410*b*'), the longitudinal edge that is closest to the centerline 408 of the airform membrane 401 is referred to as the inner longitudinal edge, and the longitudinal edge that is farthest from the centerline 408 is referred to as the outer longitudinal edge. The base edges 414*a*, 415*a* and the longitudinal edges 416*a*, 417*a* can define a perimeter 418*a* of the span 410*a*. The base edges 414*b*, 415*b* and the longitudinal edges 416*b*, 417*b* can define a perimeter 418*b* of the span 410*b*. The base edges 414*b*', 415*b*' and the longitudinal edges 416*b*', 417*b*' can define a perimeter 418*b*' of the span 410*b*'. Outer spans (also known as edge or end spans), such as the spans 410*c*, 410*c*', can include a single base edge and a single longitudinal edge. For example, the span 410*c* can have a single base edge 414*c* and a single longitudinal edge 416*c*, and the span 410*c*' can have a single base edge 414*c*' and a single longitudinal edge 416*c*'. For the outer or end spans 410*c*, 410*c*', the single longitudinal edges 416*c*, 416*c*' are inner longitudinal edges. The outer or end spans 410*c*, 410*c*' do not have outer longitudinal edges. The base edge 414*c* and the longitudinal edge 416*c* can define a perimeter 418*c* of the span 410*c*. The base edge 414*c*' and the longitudinal edge 416*c*' can define a perimeter 418*c*' of the span 410*c*'. In one aspect, the perimeters 418*a-c*, 418*b*'-c' can be configured such that the spans 410*a-c*, 410*b*'-c' are coupleable to one another to form an airform membrane configured as a dome. In a particular aspect, the perimeters 418*a-c*, 418*b*'-c' can be configured such that the airform membrane 401 has a height to base diameter ratio (i.e., H:D) of from about 1:2.1 to about 1:12.

The master span 410 can include a perimeter 420 defined by base edges 421*a*, 421*b* that partially define the base perimeter 411 of the final desired shape and size airform membrane 401. Thus, the base perimeter 411 of the airform membrane 401 can be sized to couple with a base support structure. The perimeter 420 can be further defined by longitudinal edges 422*a*, 422*b* having opposite ends that terminate at the base edges 421*a*, 421*b*. The longitudinal edges 422*a*, 422*b* can be configured to couple to a longitudinal edge of an adjacent span of the airform membrane 401.

Each span 410*a-c*, 410*b*'-c' has the same fundamental or basic shape, which is the shape of the master span 410. The difference in the spans 410*a-c*, 410*b*'-c' is in the "cuts," which are defined by the base perimeter 411, and cut off the master span 410 to achieve a desired base perimeter size of the airform membrane 401 for coupling with a base support structure. For example, the center span 410*a* can be based on the master span 410 in an unaltered or uncut configuration. The span 410*b* can be based on the master span 410 as cut or modified along the lines 423*a*, 423*b*, which represent intersections of the master span 410 with the base perimeter 411. The span 410*c* can be based on the master span 410 as cut or modified along the line 424, which represents an intersection of the master span 410 with the base perimeter 411.

A width dimension 426 of the master span 410 can be based on a width dimension of an available material stock. Thus, the spans 410*a-c*, 410*b*'-c' of the airform membrane 401 can be sized to maximize material usage and minimize waste. The center span configuration of the airform membrane 401 can be selected as desired (i.e., a single center span or a dual center span), for example, to provide an acceptable distribution of spans along a cross-line of the airform membrane that is orthogonal to the centerline 408. For example, an airform membrane may initially be configured based on a dual center span configuration. If the end span cut of the master span 410 leaves too little material for the end span, then the configuration can be changed to a single center span configuration in order to shift the position of the end span cut line (e.g., line 424) on the master span 410 thereby providing more material for the end span (e.g., span 410*c*). Once an acceptable span configuration has been determined for an airform membrane that is symmetric about its centerline, the spans can be mirrored about the centerline to provide a complete set of spans for the airform membrane. In the present example, spans 410*b*, 410*c* can be duplicated to provide spans 410*b*', 410*c*', respectively. In a single center span configuration, the center span straddles the centerline of the airform membrane and there can be two of every other span. In a dual center span configuration, the inner longitudinal edges of the two center spans are on the centerline of the airform membrane and there can be two of every span (including the two center spans). When constructed, the seam overlaps of adjacent spans can be directed downward (e.g., like shingles) to facilitate water run-off.

Although not illustrated, it should be recognized that material can be included (e.g., about 2-4 inches) to accommodate a seam or weld along the longitudinal edges of the spans 410*a-c*, 410*b*'-c'. In addition, material can be included at the base edges of the spans 410*a-c*, 410*b*'-c' to accommodate coupling the base edges to a base support structure. For example, about 7 inches can be added to accommodate a hemmed opening for a rope that can be used to attach the airform membrane 401 to a base support structure. If needed, a single span can include multiple fabric sheets or fabric sheet portions/segments in order to construct the span. For example, the width dimension 426 may be sized to fit the width of a fabric sheet stock, but a length dimension 427 of the span may exceed that of a single fabric sheet. In this case, two or more fabric sheets may be combined end-to-end to provide the material needed in the length dimension 427 of the span. This approach can also contribute to maximizing material usage.

Materials used to create the spans of an airform membrane typically stretch when the airform membrane is inflated. Some materials stretch uniformly in multiple directions and some do not. In the case of fabric materials, the long dimension of the material stock (e.g., the length) is called warp, and the short dimension of the material stock (e.g., the width) is called fill. Most fabrics stretch more in fill (e.g., about 3%-5%) than in warp (e.g., about 1%), although some fabrics stretch about the same in both fill and warp (e.g., about 1%-2%). The master span 410, which is based on the final desired shape of the airform membrane 401, and the spans defined by the cuts from the master span 410, do not account or compensate for this stretching of the material and are therefore "unloaded" span patterns. Thus, if an airform with unloaded spans were to be inflated, the airform would stretch to be taller and wider than desired. Accordingly, a "loaded" span pattern accounts for the material stretch by shrinking the unloaded span pattern based on the stretch the material will experience when inflated or loaded (e.g., placed in tension). For example, the tension in the inflated airform 401 can be calculated in both horizontal and vertical directions. The unloaded span width can be reduced based on the horizontal tension and fabric stretch characteristics. The unloaded span length or pattern distance can also be reduced based on the vertical tension and fabric stretch characteristics, the reduced dimensions being based on an intended or final state dimension that the span will have upon installation of the airform membrane. The result of these width and length reductions can provide a loaded span pattern. The loaded span pattern will be smaller than the unloaded version, with the width being more affected than the length for materials that stretch more in fill than in warp. FIG. 5 illustrates unloaded patterns 430*a-c*, 430*b*'-c' and loaded patterns 440*a-c*, 440*b*'-c' for the spans 410*a-c*, 410*b*'-c', respectively.

A loaded span pattern, however, may result in a base perimeter of the airform membrane that will not properly fit a base support structure, due to the amount of shrinkage at the base edges of the spans from the original unloaded pattern dimensions. For example, on a large airform membrane as much as 6 feet of material may be removed from the base perimeter in the loaded span patterns. However, accounting for material stretch near the base perimeter of the airform membrane is not necessary because inflation tension in the airform membrane near the base perimeter has only a minor effect on membrane distortion due to the support provided by the attachment to the base support structure. In other words, the base support structure supports the airform membrane and resists the distortion caused by tension in the membrane when inflated. This "ground effect," however, is only manifest near the base support structure (e.g., within about 4-8 feet). As a result, the airform membrane and, therefore, the individual spans, can "flare" out from a shrunken load compensated size to the unloaded or final desired size at the base perimeter. The flare can be configured to gradually transition from the smaller load compensated size to the larger unloaded size.

Thus, the spans 410*a-c*, 410*b*'-c' in the constructed airform membrane 401 can be hybrids of the loaded span patterns 440*a-c*, 440*b*'-c' and the unloaded span patterns 430*a-c*, 430*b*'-c'. The spans 410*a-c*, 410*b*'-c' used to construct the airform membrane 401 can have load compensated regions and flare regions that transition from the load compensated regions to unloaded base edges. The load compensated regions can have a length dimension and/or a width dimension reduced from an intended or final state dimension to compensate for material stretch when the airform membrane 401 is inflated. The flare regions can transition in the length dimension and/or the width dimension between the load compensated region and the unloaded base edges, and in a more specific example to the unloaded base edges. For example, the span 410*a* can have a flare region 432*a* that transitions between the load compensated region 442*a* and the unloaded base edge 414*a*, and a flare region 433*a* that transitions between the load compensated region 442*a* and the unloaded base edge 415*a*. The span 410*b* can have a flare region 432*b* that transitions between the load compensated region 442*b* and the unloaded base edge 414*b*, and a flare region 433*b* that transitions between the load compensated region 442*b* and the unloaded base edge 415*b*. The span 410*b*' can have a flare region 432*b*' that transitions between the load compensated region 442*b*' and the unloaded base edge 414*b*', and a flare region 433*b*' that transitions between the load compensated region 442*b*' and the unloaded base edge 415*b*'. The span 410*c* can have a flare region 432*c* that transitions between the load compensated region 442*c* and the unloaded base edge 414*c*. The span 410*c*' can have a flare region 432*c*' that transitions between the load compensated region 442*c*' and the unloaded base edge 414*c*'. In these examples, although this is not intended to be limiting, each of the flare regions are shown transitioning from the load compensated region to the unloaded base edge. Also, every production span 410*a-c*, 410*b*'-c' is fundamentally the same, with the difference being the cut of the spans from the master span 410 intersecting with the base perimeter 411 and the application of flare after being "cut" from the master span 410.

As mentioned above, due to the ground effect of a base support structure, the flare in the airform membrane 401 is only applied near the base perimeter 411. In one aspect, a length 428 of a flare level or region from the base perimeter 411 (e.g., the base edges of the spans) to the load compensated region is from about 3% to about 7% (with 5% being typical) of a surface length across the airform membrane 401 (i.e., from the base perimeter 411 to the top of the airform membrane 401). In other words, the length 428 can be the same for all flare regions of the spans from the base edges of the spans to the load compensated regions of the spans, which is from about 3% to about 7% (with 5% being typical) of a surface length from the base perimeter 411 to the top of the airform membrane 401. For airform shapes that are symmetric about a vertical axis of rotation, the surface length from the base perimeter 411 to the top of the airform membrane 401 can be the surface length of half of the centerline 408 of the airform membrane 401. The boundary between the flare regions and the load compensated regions is indicated at 429 and can resemble a ring around the airform membrane 401 parallel to the base perimeter 411 (see FIG. 4). In other words, the boundary line 429 can be a contour line offset from the base perimeter 411 by a given distance, which can be in terms of a vertical distance and/or a surface distance along the airform membrane 401. For example, the boundary line 429 can be located at a vertical distance from the base perimeter 411 of from about 3% to about 7% (with 5% being typical) of the vertical height H of the airform membrane 401. For airform shapes that are not symmetric about a vertical axis of rotation (e.g., semi prolate ellipsoids and semi oblate ellipsoids that have non-vertically oriented axes of revolution and elliptical base perimeters), the surface length from the base perimeter to the top of the airform membrane can be determined at any given point along the base perimeter to the top of the airform membrane. In this case, the vertical height of the boundary between the flare region and the load compensated region can be constant about the base perimeter, but the surface distance can vary along the base perimeter. For example, in the case of an elliptical shaped base perimeter, the flare region can extend a greater surface distance up the airform membrane from the base perimeter at the ends of the elliptical base perimeter (e.g., proximate the major axis) compared to the sides of the elliptical base perimeter (e.g., proximate the minor axis).

For each transverse span, the flare regions can be determined and the length and width dimensions gradually adjusted accordingly to provide a smooth transition to the unloaded base edges. For example, once the distance above the base perimeter 411 has been determined, thus defining the flare regions, the flare can be applied within the flare regions as a percentage of the vertical distance. Thus, at the boundary line 429 (e.g., the top of the flare region) the spans are 100% loaded. At the base perimeter 411, the spans are 0% loaded. The flare or percentage of loading within the flare regions can vary linearly or according to a function of the vertical distance from the base perimeter to the top of the flare regions in order to smoothly transition the length and/or width dimensions from the load compensated region to the base edges of each span.

It is to be understood by those skilled in the art that the term "flare region" is intended to describe the flare regions of individual transverse spans (e.g., see FIG. 5), as well as the more global flare region of an airform membrane (e.g., see FIG. 4) formed from a plurality of transverse spans. Similarly, the term "load compensated region" is intended to describe the load compensation regions of individual transverse spans (e.g., see FIG. 5), as well as the more global load compensated region of an airform membrane (e.g., see FIG. 4) formed from a plurality of transverse spans.

The center spans are typically affected the most by load compensation dimension reductions in terms of how these spans attach to a base support structure, while the end spans are affected the least. Because fabric warp threads typically stretch less than fill threads, a relatively large amount of material is typically removed at the end of the center spans in the width (fill thread) dimension to compensate for material stretch compared to that removed from the end spans in the length (warp thread) direction. In other words, spans near the centerline of an airform membrane (e.g., interior spans) have fill threads that are substantially parallel to the base perimeter, so these spans are affected most. Spans near the edge of the airform membrane (e.g., outer or edge spans) have warp threads that are substantially parallel to the base perimeter, so these spans are less affected. It is desirable to apply flare uniformly around the airform membrane. The base perimeter is full size and unloaded. The spans become increasingly "loaded" as the distance from the base perimeter increases until the spans are fully loaded at the load compensation region. For example, the ring 429 crosses each span 410*a-c*, 410*b*'-c' over increasingly longer distances from the center span 410*a* to the outer spans 410*c*, 410*c*'. Transverse spans must therefore be "relaxed" over longer distances but in varying degrees in the transition from fill thread to warp thread elongation. The transverse spans 410*a-c*, 410*b*'-c' of the airform membrane 401 can therefore be designed with consideration of the inflated size, accounting for fabric stretch and attachment to a base support structure.

In one example, the desired shape of an airform membrane can be modeled mathematically with a coordinate center as the center of the overall shape. The shape can be "cut" at a known z-coordinate above the center. The sector above the z-coordinate can be the membrane form to pattern. The modeled airform membrane can be marked at points equal to the maximum desired fabric width across the center of the form. A plane can intersect through the shape's coordinate center and each span mark to create a mathematical slice through the modeled airform membrane. The slices can be followed along the modeled airform membrane at set intervals recording x, y, and z coordinates of each point. The resulting shapes can represent the unloaded or nominal spans. The formulas for inflatable membrane tension are known and published. Using these formulas, local tension can be calculated in the warp and fill directions of fabric material at each point when inflated at the target air pressure. The warp and fill percentage stretch at a local point can be extrapolated using the calculated tension in both directions and fabric stretch characteristics previously measured by a calibrated test rig. The distance from the top of the modeled airform membrane can be measured along a span. The warp distance can be reduced by the stretch percentage at each point. The width of the span at each point can also be calculated by reducing the fill width by the stretch percentage. The resulting array of distance and widths can represent a loaded span.

Ground effect forces the membrane to match the rigid base support structure. However, the loaded spans are too small to match the base perimeter, so the airform membrane can flare out to the base perimeter. The asymmetrical loaded pattern can be unloaded in a reverse manner. For example, the z-coordinate above the base perimeter that represents the top of the ground effect can be calculated. This can be approximated by 3%-7% (with 5% being typical) of the airform membrane height. However, different designs and shape may change the percentage up or down as desired by one skilled in the art. For each point marked on the span calculated to be below the ground effect z-coordinate and above the membrane base z-coordinate, a percentage of the ground effect can be calculated at that point. The ground effect z-coordinate line is zero percent. The membrane base is 100 percent. Points in between can vary linearly or according to a function (e.g., a sine function). Warp and fill percentage loading is lessened reduced by the ground effect percentage. At the ground effect z-coordinate the spans are fully loaded. By the membrane base, the spans are completely unloaded or not compensated for stretch. This can create the desired flare in the span patterns. The spans can be loaded above the ground effect z-coordinate and then slowly unloaded closer to the membrane base perimeter. The flared airform membrane can be approximately the same perimeter as the base support structure.

Figure 7:
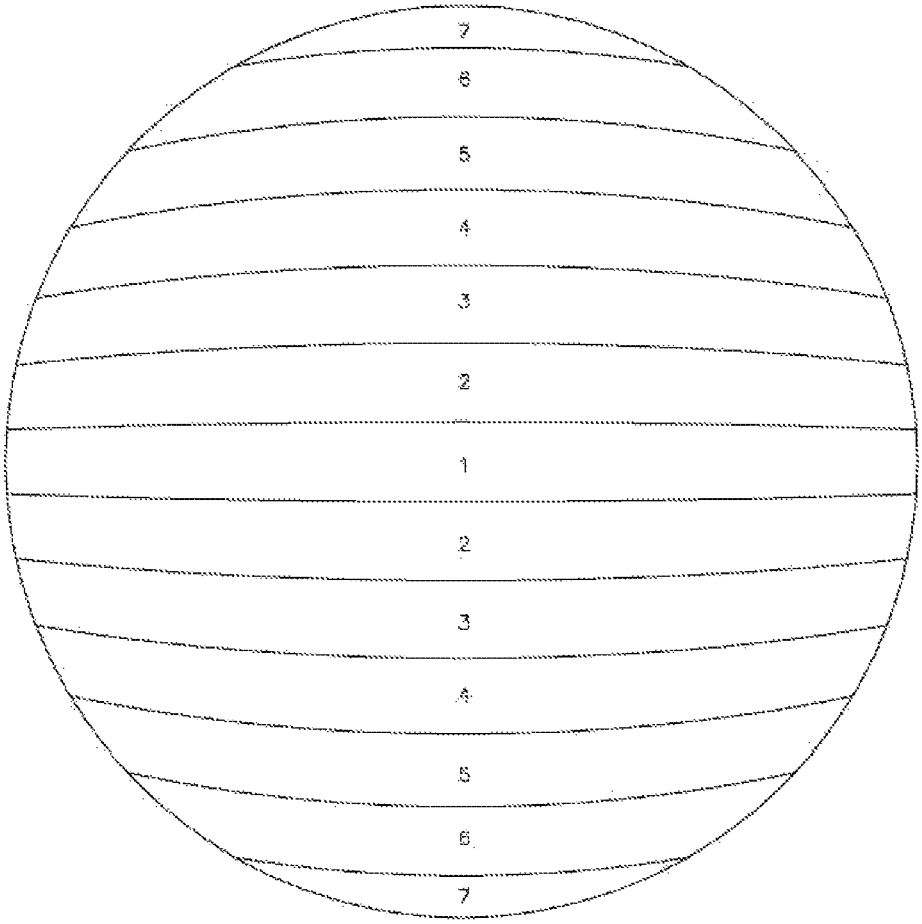
FIG. 7 is a top view of a transverse span airform membrane in accordance with yet another example of the present disclosure.
Figure 8:
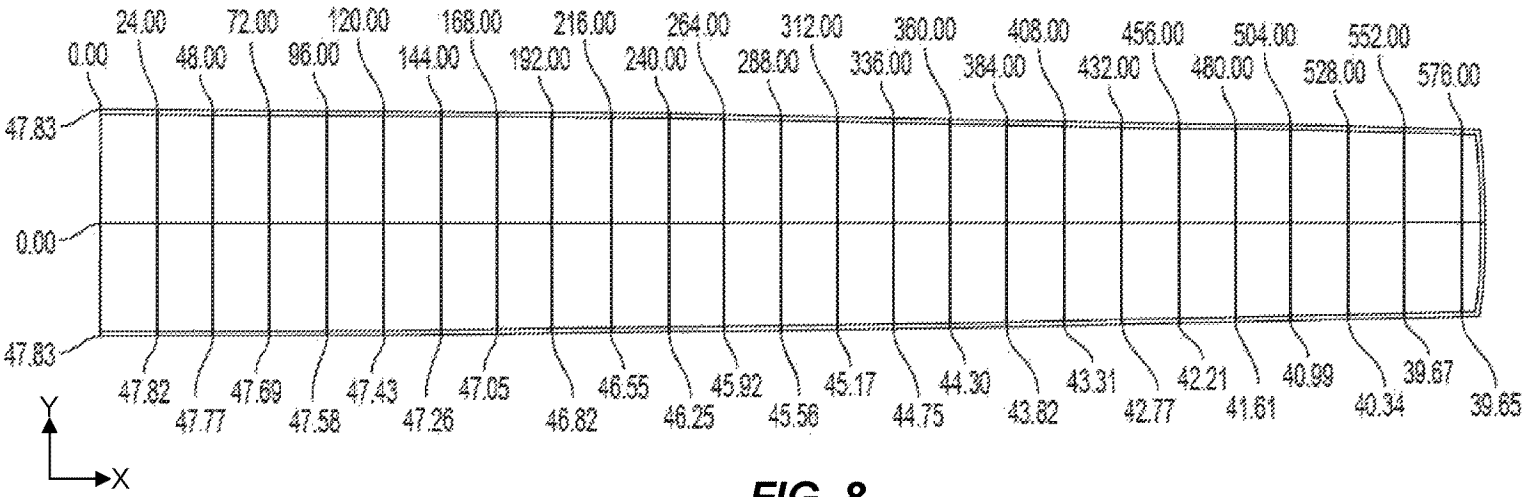
FIG. 8 is a detailed dimensional layout of a master transverse span used to create the transverse span airform membrane of FIG. 7, in accordance with an example of the present disclosure.
Figure 9:
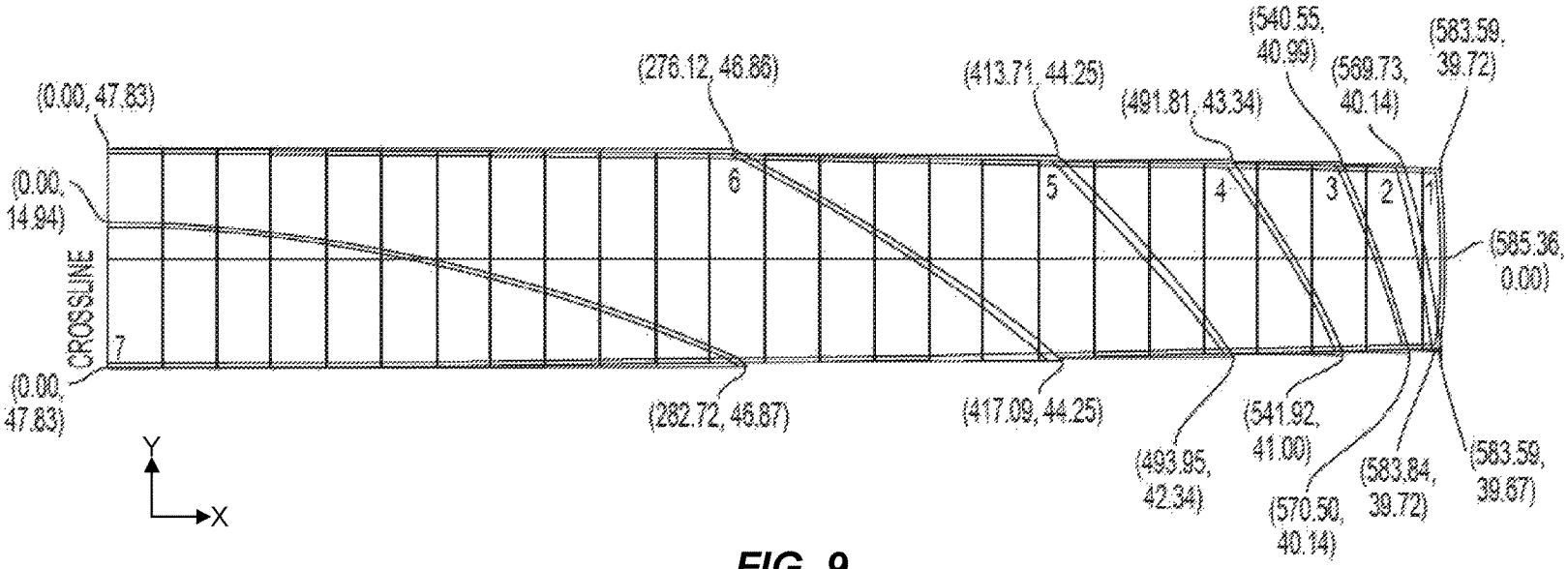
FIG. 9 is a detailed dimensional layout of individual transverse spans used to create the transverse span airform membrane of FIG. 7, in accordance with an example of the present disclosure.

FIGS. 7-9 illustrate an example of an airform membrane and transverse span configuration. FIG. 7 is a top view of a transverse span airform membrane. FIG. 8 is a detailed dimensional layout of a master transverse span used to create the transverse span airform membrane of FIG. 7, and FIG. 9 is a detailed dimensional layout of individual transverse spans used to create the transverse span airform membrane of FIG. 7. Only the right halves of the spans of FIGS. 8 and 9 are illustrated. The complete spans can be obtained by mirroring the spans about the left-most vertical line (labeled "crossline" in FIG. 9). In FIG. 8, the dimensions of the master span are shown with Y coordinates (e.g. width dimension) from the span mid-line indicated above the master span, and X coordinates (e.g., length dimension) from the span crossline indicated below the master span. In FIG. 9, the dimensions for the individual production spans are indicated as X-Y coordinate pairs relative to the crossline and midline, respectively. The subtle flare of the spans is also evident in FIG. 9.

Figure 10:
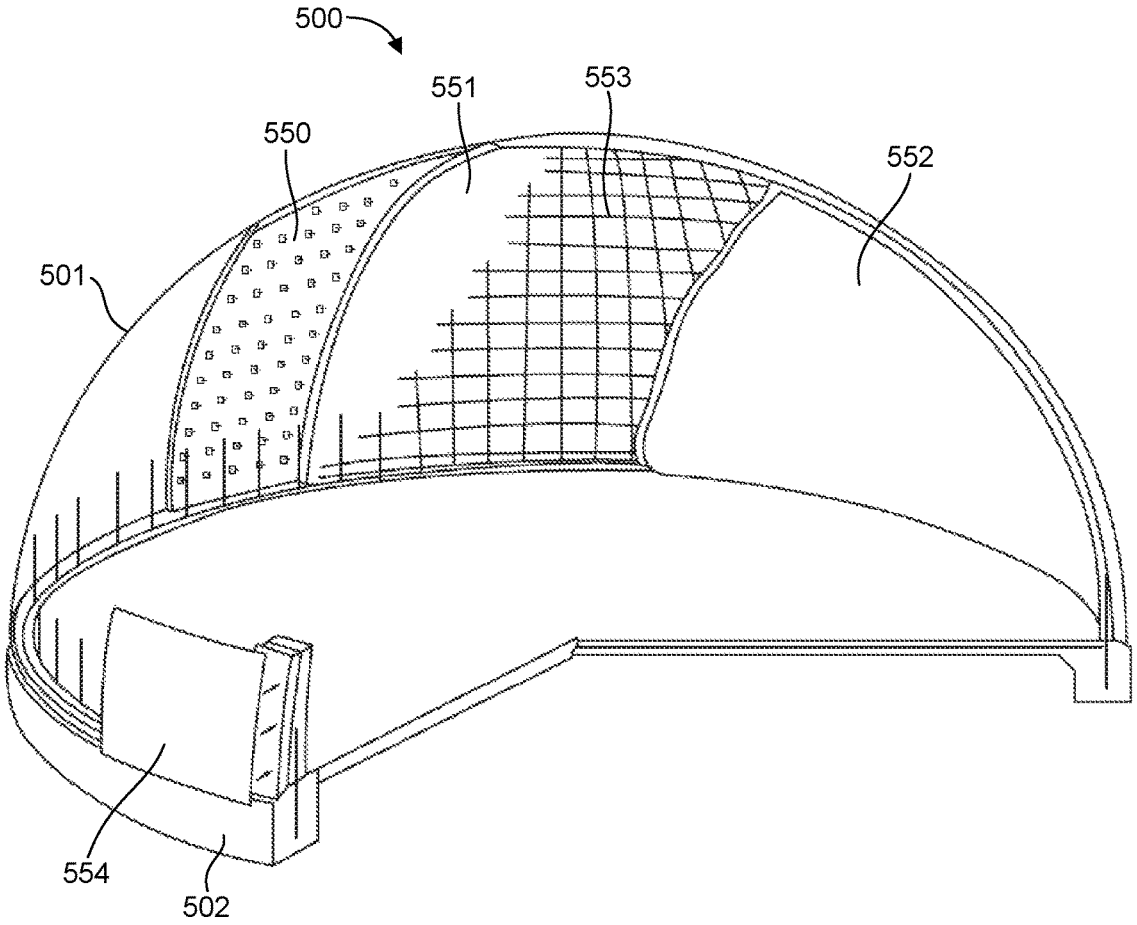
FIG. 10 is a schematic cutaway illustration of a building structure in accordance with an example of the present disclosure.

FIG. 10 illustrates a building structure 500 in accordance with an example of the present disclosure. Such a building structure can be referred to as a monolithic dome having an airform membrane as discussed herein. The building structure 500 is represented schematically in cutaway to show certain features of the building structure. The building structure 500 can include a base support structure 502 and an airform membrane 501 coupled to the base support structure 502 and in an inflated configuration. The base support structure 502 can be any suitable support or foundation for the building structure 500. The airform membrane 501 serves as a framework or skeleton for construction of a rigid dome. The airform membrane 501 is attached to the base support structure 502 and inflated, typically with blower fans, to create the shape of the dome structure to be completed. The fans run throughout construction of the rigid dome. Entrance into the air-inflated structure can be made through a double door airlock to keep the air pressure inside at a constant level. The building structure 500 can include one or more insulating layers 550, 551 (e.g., a foam insulation) formed about the airform membrane 501. The insulating layers 550, 551 can be formed about an inner surface of the airform membrane 501, as illustrated, and/or about an outer or exterior surface of the airform membrane 501. For example, once the airform membrane 501 is inflated, polyurethane foam can be sprayed or otherwise applied to the interior surface of the airform membrane 501. In addition, the building structure 500 can include a cementitious layer 552 (e.g., shotcrete) formed about the airform membrane 501. The cementitious layer 552 can be formed about an inner surface of the airform membrane 501, such as sprayed on an inner surface of the insulating layer 551 as shown in the figure. The cementitious layer 552 can be reinforced, such as with reinforcing bars 553 and/or a mesh. For example, steel rebar can be attached to the insulation, then embedded with concrete. Thus, the insulation can also serve as a base for attaching the reinforcing bars 553. The blower fans can be shut off after the cementitious layer 552 has set. The building structure 500 can have an exterior coating 554 formed about an outer surface of the airform membrane 501. The exterior coating 554 can be any suitable type of coating. In one aspect, the exterior coating 554 can comprise a cementitious layer.

Figure 11:
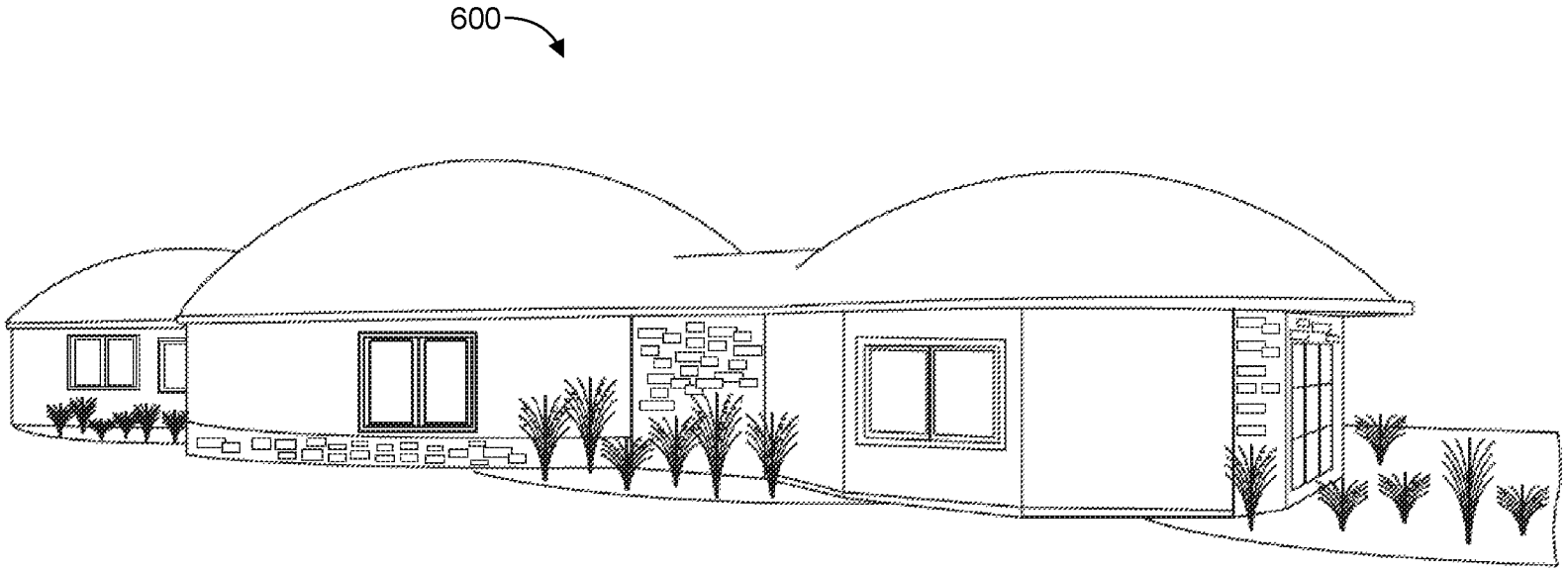
FIG. 11 is an illustration of a multi-dome building structure in accordance with an example of the present disclosure.
Figure 12:
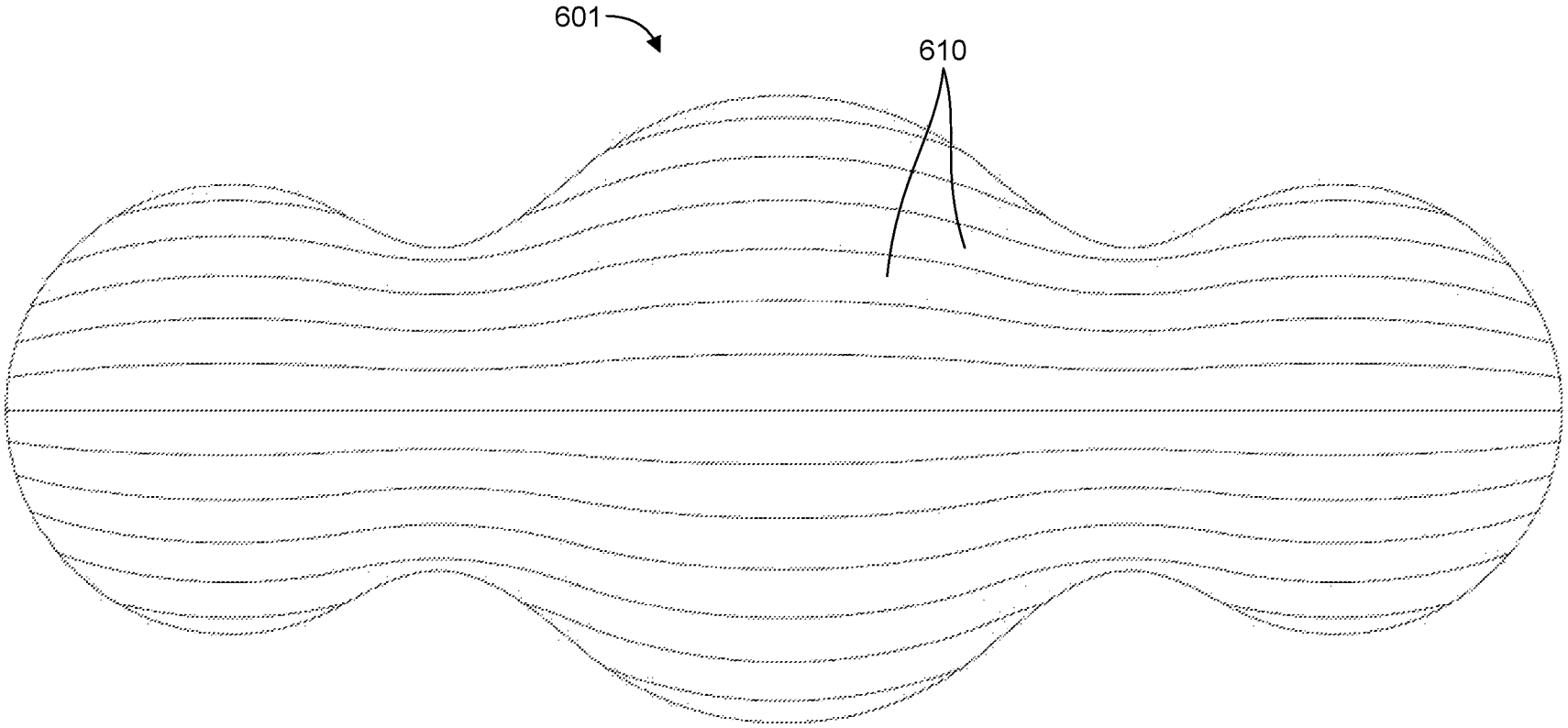
FIG. 12 is a top view of a multi-dome transverse airform membrane used to construct the multi-dome building structure of FIG. 11, in accordance with an example of the present disclosure.

FIG. 11 illustrates a building structure 600 in accordance with another example of the present disclosure. The building structure 500 of FIG. 10 is an example of a typical single dome configuration. The building structure 600 is an example of a multi-dome configuration, which includes multiple domes typically configured as semi spheroids (e.g., one or more semi spheres and/or semi ellipses), although other dome configurations are possible. FIG. 12 illustrates a plan view of a multi-dome airform membrane 601 that may be used to construct the building structure 600. The airform membrane 601 includes transverse spans (referred to generally at 610) in accordance with the principles disclosed herein. In this example, the spans 610 are configured to extend in the greatest dimension (e.g., along a length) of the airform 601. This illustrates how the use of transverse spans can greatly simplify the design and manufacture of complex airform membranes (e.g., multi-dome airforms) compared to typical radial gores, which present many challenges for such complex configurations. For example, the transverse spans make possible long, continuous seams along the length of the airform membrane 601, which are easy to weld, as opposed to the complex orientation and location of seams that would be needed to construct a similarly shaped airform membrane with radial gores. The use of transverse spans can also drastically reduce the number of individual spans required for the airform membrane 601 when compared to the number of gores that would be required to construct the same multi-dome shape. In addition, with transverse spans there are no intersections or seams in saddles, which is typically the case with radial gore multi-dome airform configurations.

In accordance with one embodiment of the present invention, a method is disclosed for manufacturing transverse spans for an airform membrane configured to couple to a base support structure to form a building structure. The method can comprise defining an airform membrane having a base perimeter. The method can also comprise defining a master transverse span based on the airform membrane, the master transverse span having a length dimension and a width dimension. The method can further comprise defining a plurality of unloaded transverse spans based on the master span, wherein each of the plurality of unloaded transverse spans has at least one base edge based on the base perimeter of the airform membrane. The method can still further comprise defining a plurality of loaded transverse spans based on the plurality of unloaded transverse spans, wherein at least one of the length dimension and the width dimension of the plurality of loaded transverse spans are reduced relative to the plurality of unloaded transverse spans to compensate for stretch of a material of the airform membrane when the airform membrane is inflated. The method can even further comprise defining a load compensated region relative to each of the plurality of loaded transverse spans, which defines a load compensated region for each of a plurality of production transverse spans. The method can even further comprise flaring each of the plurality of loaded transverse spans by transitioning at least one of the length dimension and the width dimension between the load compensated region and the at least one base edge of each of the plurality of unloaded transverse spans, which defines a flare region for each of the plurality of production transverse spans. Additionally, the method can comprise forming each of the plurality of production transverse spans from a material, wherein each of the plurality of production transverse spans includes at least one longitudinal edge having opposite ends that terminate at at least one base edge, the at least one longitudinal edge being configured to couple to a longitudinal edge of an adjacent transverse span of the airform membrane. It is noted that no specific order is required in this method, though generally in one embodiment, these method steps can be carried out sequentially.

In one aspect of the method, a length of the flare region from the at least one base edge can be from about 3% to about 7% of a surface length of a centerline of the airform membrane. In another aspect of the method, the material comprises fill threads and warp threads. In a particular aspect of the method, the fill threads and the warp threads stretch differently. In another particular aspect of the method, the warp threads are substantially aligned with the length dimension, and the fill threads are substantially aligned with the width dimension. In yet another aspect of the method, a height to base diameter ratio of the airform membrane can be from about 1:2.1 to about 1:12. In a particular aspect of the method, a height to base diameter ratio of the airform membrane can be from about 1:4 to about 1:9.

In accordance with one embodiment of the present invention, a method for making a building structure is disclosed. The method can comprise obtaining a transverse span airform membrane having a plurality of transverse spans coupled to one another, wherein at least one of the transverse spans comprises a material having a perimeter defined at least in part by at least one longitudinal edge having opposite ends that terminate at at least one base edge further defining the perimeter, the at least one longitudinal edge being configured to couple to a longitudinal edge of an adjacent transverse span of the airform membrane, the at least one base edge at least partially defining a base perimeter of the airform membrane, and a load compensated region with at least one of a length dimension and a width dimension reduced from an intended final dimension to compensate for stretch of the material when the airform membrane is inflated, and at least one flare region between the load compensated region and the at least one base edge, the at least one flare region transitioning in at least one of the length dimension and the width dimension from the load compensated region. Additionally, the method can comprise coupling the base perimeter of the transverse span airform membrane to a base support structure. It is noted that no specific order is required in this method, though generally in one embodiment, these method steps can be carried out sequentially.

In one aspect of the method, the at least one flare region can transition in at least one of the length dimension and the width dimension from the load compensated region to the at least one base edge. In one aspect, the method can further comprise inflating the transverse span airform membrane. In another aspect, the method can further comprise disposing insulation about the transverse span airform membrane. In yet another aspect, the method can further comprise disposing cementitious material about the transverse span airform membrane.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to "one embodiment" or "an embodiment" means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In the following description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. A transverse span for an airform membrane, comprising:

a material having a perimeter defined at least in part by at least one longitudinal edge having opposite ends that terminate at at least one base edge further defining the perimeter, the at least one longitudinal edge comprising a curve, and being configured to couple to a longitudinal edge of an adjacent transverse span of an airform membrane, the at least one base edge at least partially defining a base perimeter of the airform membrane for coupling with a base support structure, and a load compensated region with at least one of a length dimension and a width dimension being less than an intended final dimension to compensate for stretch of the material when the airform membrane is inflated, and at least one flare region between the load compensated region and the at least one base edge, wherein the at least one longitudinal edge flares outward toward the at least one base edge beginning at an intersection of the at least one longitudinal edge and a boundary between the at least one flare region and the load compensated region, the intersection defining an inflection point at which the curve of the at least one longitudinal edge changes direction, such that the at least one flare region transitions in at least one of the length dimension and the width dimension between the load compensated region and the at least one base edge.

2. The transverse span of claim 1, wherein the material comprises a fabric sheet.

3. The transverse span of claim 2, wherein the fabric sheet comprises a plurality of sheet segments.

4. The transverse span of claim 1, wherein the at least one base edge comprises first and second base edges.

5. The transverse span of claim 4, wherein the at least one longitudinal edge comprises first and second longitudinal edges, and opposite ends of the first and second longitudinal edges terminate at the first and second base edges, respectively.

6. The transverse span of claim 4, wherein the at least one flare region comprises first and second flare regions between the load compensated region and the first and second base edges.

7. The transverse span of claim 1, wherein the at least one base edge comprises a single base edge.

8. The transverse span of claim 7, wherein the at least one longitudinal edge comprises a single longitudinal edge, and opposite ends of the single longitudinal edge terminate at the single base edge.

9. The transverse span of claim 7, wherein the at least one flare region comprises first and second flare regions between the load compensated region and the single base edge.

10. The transverse span of claim 1, wherein a length of the at least one flare region from the at least one base edge is from about 3% to about 7% of a surface length of a centerline of the airform membrane.

11. A transverse span airform membrane, comprising:

a plurality of transverse spans coupled to one another, wherein at least one of the transverse spans comprises:

a material having a perimeter defined at least in part by at least one longitudinal edge having opposite ends that terminate at at least one base edge further defining the perimeter, the at least one longitudinal edge comprising a curve, and being configured to couple to a longitudinal edge of an adjacent transverse span of the airform membrane, the at least one base edge at least partially defining a base perimeter of the airform membrane for coupling with a base support structure, and a load compensated region with at least one of a length dimension and a width dimension being less than an intended final dimension to compensate for stretch of the material when the airform membrane is inflated, and at least one flare region between the load compensated region and the at least one base edge, wherein the at least one longitudinal edge flares outward toward the at least one base edge beginning at an intersection of the at least one longitudinal edge and a boundary between the at least one flare region and the load compensated region, the intersection defining an inflection point at which the curve of the at least one longitudinal edge changes direction, such that the at least one flare region transitions in at least one of the length dimension and the width dimension between the load compensated region and the at least one base edge.

12. The transverse span of claim 11, wherein the at least one of the transverse spans comprises a plurality of transverse spans, and wherein the at least one flare regions of adjacent transverse spans are coupled together.

13. The transverse span airform membrane of claim 11, wherein the at least one flare region transitions from the load compensated region to the at least one base edge.

14. The transverse span airform membrane of claim 11, wherein each of the transverse spans comprises a load compensated region and a flare region.

15. The transverse span airform membrane of claim 11, wherein the plurality of transverse spans is configured to form a dome.

16. The transverse span airform membrane of claim 15, wherein the dome comprises a surface of revolution.

17. The transverse span airform membrane of claim 16, wherein the surface of revolution is a semi spheroid.

18. The transverse span airform membrane of claim 17, wherein the semi spheroid is a semi sphere.

19. The transverse span of claim 18, wherein the semi sphere is less than half of a sphere.

20. The transverse span airform membrane of claim 17, wherein the semi spheroid is a semi ellipsoid.

21. The transverse span airform membrane of claim 20, wherein the semi ellipsoid is less than half of an ellipsoid.

22. The transverse span airform membrane of claim 20, wherein the semi ellipsoid comprises a semi prolate ellipsoid.

23. The transverse span airform membrane of claim 20, wherein the semi ellipsoid comprises a semi oblate ellipsoid.

24. The transverse span airform membrane of claim 15, wherein the dome comprises a multi-dome configuration.

25. The transverse span airform membrane of claim 24, wherein the multi-dome configuration comprises a plurality of at least one of a semi sphere and a semi ellipse.

26. The transverse span airform membrane of claim 11, wherein the transverse span airform membrane is configured to have a height to base diameter ratio of from 1:2.1 to 1:12 when inflated.

27. The transverse span airform membrane of claim 26, wherein the height to base diameter ratio is from 1:4 to 1:9.

28. A transverse span airform membrane comprising:

a plurality of transverse spans coupled to one another, wherein at least one of the transverse spans comprises:

a material having a perimeter defined at least in part by at least one longitudinal edge having opposite ends that terminate at at least one base edge further defining the perimeter, the at least one longitudinal edge comprising a curve, and being configured to couple to a longitudinal edge of an adjacent transverse span of the airform membrane, the at least one base edge at least partially defining a base perimeter of the airform membrane for coupling with a base support structure;

a load compensated region having a dimension less than an intended final dimension to compensate for stretch of the material when the airform membrane is inflated; and a flare region transitioning in the dimension between the load compensated region and the base perimeter, wherein the at least one longitudinal edge flares outward toward the at least one base edge beginning at an intersection of the at least one longitudinal edge and a boundary between the flare region and the load compensated region, the intersection defining an inflection point at which the curve of the at least one longitudinal edge changes direction.

29. The transverse airform span membrane of claim 28, wherein the load compensated region includes portions of a plurality of transverse spans.

30. The transverse airform span membrane of claim 28, wherein the flare region includes portions of a plurality of transverse spans.

31. A building structure, comprising:

a base support structure; and a transverse span airform membrane coupled to the base support structure and in an inflated configuration, wherein the transverse span airform membrane comprises a plurality of transverse spans, at least one of the transverse spans comprising:

a material having a perimeter defined at least in part by at least one longitudinal edge having opposite ends that terminate at at least one base edge further defining the perimeter, the at least one longitudinal edge comprising a curve, and being configured to couple to a longitudinal edge of an adjacent transverse span of the airform membrane, the at least one base edge at least partially defining a base perimeter of the airform membrane for coupling with the base support structure, and a load compensated region with at least one of a length dimension and a width dimension being less than an intended final dimension to compensate for stretch of the material when the airform membrane is inflated, and at least one flare region between the load compensated region and the at least one base edge, wherein the at least one longitudinal edge flares outward toward the at least one base edge beginning at an intersection of the at least one longitudinal edge and a boundary between the at least one flare region and the load compensated region, the intersection defining an inflection point at which the curve of the at least one longitudinal edge changes direction, such that the at least one flare region transitions in at least one of the length dimension and the width dimension between the load compensated region and the at least one base edge.

32. The building structure of claim 31, wherein the at least one flare region transitions from the load compensated region to the at least one base edge.

33. The building structure of claim 31, further comprising a cementitious layer formed about the airform membrane.

34. The building structure of claim 33, wherein the cementitious layer is formed about an inner surface of the airform membrane.

35. The building structure of claim 34, further comprising a second cementitious layer formed about an outer surface of the airform membrane.

36. The building structure of claim 33, wherein the cementitious layer is reinforced.

37. The building structure of claim 36, wherein the cementitious layer is reinforced with at least one of a mesh and one or more reinforcing bars.

38. The building structure of claim 31, further comprising an insulating layer formed about the airform membrane.

39. The building structure of claim 38, wherein the insulating layer is formed about an inner surface of the airform membrane.

40. The building structure of claim 39, further comprising a cementitious layer disposed on an inner surface of the insulating layer.

41. The building structure of claim 38, wherein the insulating layer comprises a foam insulation.

42. A method for manufacturing transverse spans for an airform membrane configured to couple to a base support structure to form a building structure, comprising:

defining an airform membrane having a base perimeter;

defining a master transverse span based on the airform membrane, the master transverse span having a length dimension and a width dimension;

defining a plurality of unloaded transverse spans based on the master span, wherein each of the plurality of unloaded transverse spans has at least one base edge based on the base perimeter of the airform membrane;

defining a plurality of loaded transverse spans based on the plurality of unloaded transverse spans, wherein at least one of the length dimension and the width dimension of the plurality of loaded transverse spans are reduced relative to the plurality of unloaded transverse spans to compensate for stretch of a material of the airform membrane when the airform membrane is inflated;

defining a load compensated region relative to each of the plurality of loaded transverse spans, which defines a load compensated region for each of a plurality of production transverse spans;

flaring each of the plurality of loaded transverse spans by transitioning at least one of the length dimension and the width dimension between the load compensated region and the at least one base edge of each of the plurality of unloaded transverse spans, which defines a flare region for each of the plurality of production transverse spans; and forming each of the plurality of production transverse spans from a material, wherein each of the plurality of production transverse spans includes at least one longitudinal edge having opposite ends that terminate at at least one base edge, wherein the at least one longitudinal edge flares outward toward the at least one base edge beginning at an intersection of the at least one longitudinal edge and a boundary between the at least one flare region and the load compensated region, the at least one longitudinal edge comprising a curve, and being configured to couple to a longitudinal edge of an adjacent transverse span of the airform membrane, the intersection defining an inflection point at which the curve of the at least one longitudinal edge changes direction.

43. The method of claim 42, wherein a length of the flare region from the at least one base edge is from about 3% to about 7% of a surface length of a centerline of the airform membrane.

44. The method of claim 42, wherein the material comprises fill threads and warp threads.

45. The method of claim 44, wherein the fill threads and the warp threads stretch differently.

46. The method of claim 44, wherein the warp threads are substantially aligned with the length dimension, and the fill threads are substantially aligned with the width dimension.

47. The method of claim 42, wherein a height to base diameter ratio of the airform membrane is from 1:2.1 to 1:12.

48. The method of claim 47, wherein a height to base diameter ratio of the airform membrane is from 1:4 to 1:9.

49. A method for making a building structure, comprising:

obtaining a transverse span airform membrane having a plurality of transverse spans coupled to one another, wherein at least one of the transverse spans comprises:

a material having a perimeter defined at least in part by at least one longitudinal edge having opposite ends that terminate at at least one base edge further defining the perimeter, the at least one longitudinal edge comprising a curve, and being configured to couple to a longitudinal edge of an adjacent transverse span of the airform membrane, the at least one base edge at least partially defining a base perimeter of the airform membrane, and a load compensated region with at least one of a length dimension and a width dimension reduced from an intended final dimension to compensate for stretch of the material when the airform membrane is inflated, and at least one flare region between the load compensated region and the at least one base edge, wherein the at least one longitudinal edge flares outward toward the at least one base edge beginning at an intersection of the at least one longitudinal edge and a boundary between the at least one flare region and the load compensated region, the intersection defining an inflection point at which the curve of the at least one longitudinal edge changes direction, the at least one flare region transitioning in at least one of the length dimension and the width dimension from the load compensated region; and coupling the base perimeter of the transverse span airform membrane to a base support structure.

50. The method of claim 49, wherein the at least one flare region transitions in at least one of the length dimension and the width dimension from the load compensated region to the at least one base edge.

51. The method of claim 49, further comprising inflating the transverse span airform membrane.

52. The method of claim 49, further comprising disposing insulation about the transverse span airform membrane.

53. The method of claim 49, further comprising disposing cementitious material about the transverse span airform membrane.

* * * * *